United States Patent [19]

Wheelwright

[11] Patent Number: 4,768,414

[45] Date of Patent: Sep. 6, 1988

[54] ADJUSTABLE SADDLE FOR INDIVIDUAL INSTRUMENT STRING

[76] Inventor: Lynn A. Wheelwright, 2618 W. 5175 South, Roy, Utah 84067

[21] Appl. No.: 10,474

[22] Filed: Feb. 3, 1987

[51] Int. Cl.[4] ..... G10D 3/04

[52] U.S. Cl. ..... 84/298; 84/307

[58] Field of Search ..... 84/298, 299, 307, 313

[56] References Cited

U.S. PATENT DOCUMENTS

| | | | |
|---|---|---|---|
| 934,678 | 9/1909 | Laurian | 84/307 |
| 2,565,253 | 8/1951 | Melita | 84/298 |
| 4,430,919 | 2/1984 | Matsui | 84/299 |
| 4,464,970 | 8/1984 | Mischakoff | 84/298 |

*Primary Examiner*—Lawrence R. Franklin

*Attorney, Agent, or Firm*—A. Ray Osburn

[57] ABSTRACT

An adjustable saddle insert for individual strings of a musical instrument. The insert may be installed upon the bridge of an existing instrument without any alteration of the bridge or of the instrument, and provides for precise selection of vibrating length of the string and its height above the instrument for precise intonation of each string. Each saddle is clamped upon the insert in selection position longitudinally to the string, and the height of each is adjusted by removal of material from its upper ridge.

5 Claims, 2 Drawing Sheets

ADJUSTABLE SADDLE FOR INDIVIDUAL INSTRUMENT STRING

BACKGROUND OF THE INVENTION

1. Field

The invention relates to improved bridges for stringed instruments, and with more particularity to such bridges providing for individual adjustment of the vibrating length of each string for intonation purposes.

2. State of the Art

Some existing bridges for stringed instruments have string supporting saddles which can be selectively positioned longitudinally to vary the string's intonation. With some, it is also possible to adjust the height of the bridge body and saddles above the instrument for proper string height for comfortable fretting. See U.S. Pat. Nos. 4,334,454, 3,605,545, 2,786,382 and 2,491,788. All of these disclosed devices are unnecessarily complex and expensive. The disclosed prior art bridges must be incorporated into the instrument as original equipment. They can be incorporated into existing instruments only by removal and replacement of the complete original bridge assemblies, which is very hazardous to the instrument. Damage to the sound box is a real concern, and serious change of acoustic properties of the instrument is almost certain. Manufacturers' guarantees are generally rendered void by such alterations. Further, any value the altered instrument might have had by virtue of collectability is very seriously impaired.

Precise intonation has recently become of increased concern because the vary sensitive sound and recording devices being employed require the truer tones to be had only by very precise individual string intonation. Clearly, the presently available devices do not meet the need for upgrading existing instruments to meet these requirements.

BRIEF SUMMARY OF THE INVENTION

With the foregoing in mind, the disadvantages and shortcomings of prior art adjustable intonation bridges are eliminated or substantially alleviated in the present invention. An individual, separate saddle insert assembly is provided for each string, each including a string contacting saddle piece which may be adjusted in position upon the instrument bridge to provide precise desired tone and pitch of the string by precise adjustment of its vibrating length. Neither the instrument nor the bridge bodies are altered in any way. It is only necessary to lift the original saddle from its slot in the bridge body. Each saddle insert may then be installed engaging the portion of the slot under its string.

Each saddle insert includes a saddle piece for the individual string, and a mounting block upon which the saddle piece is clamped in selected position. Preferably, the block rests upon the top of the bridge body, and has a downstanding projection which snugly engages the portion of the saddle slot beneath the string. The saddle piece is secured upstanding from a thin plate tray, which rests upon a horizontal surface provided upon the mounting block. An overhang above a portion of the tray has a pair of set screws for clamping the tray to the block to hold the saddle piece in selected position. The height of the string above the insttument may be adjusted by removing material from the top of the string-contacting ridge of the saddle piece. The mounting blocks are sized to provide sufficient room in the bridge slot to adjust the saddle transversely to the strings. Each mounting block may, if desired, include a piezo-electric sound pickup device as often used with amplification and speaker systems.

It is therefore the principal object of the invention to provide an economical device for conversion of instruments having fixed saddle bridges into adjustable saddle bridges for individual string intonation, without destruction or alteration of any part of the original instrument.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
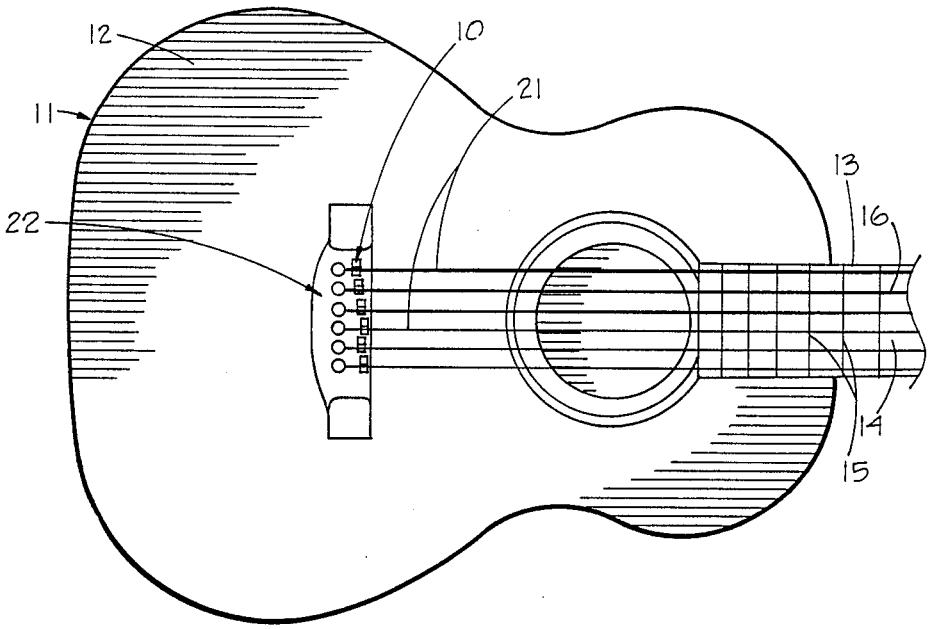
FIG. 1 is a plan view of a fragment of a guitar including the sound chamber thereof, showing saddle inserts in accordance with the invention, drawn to a reduced scale.
Figure 2:
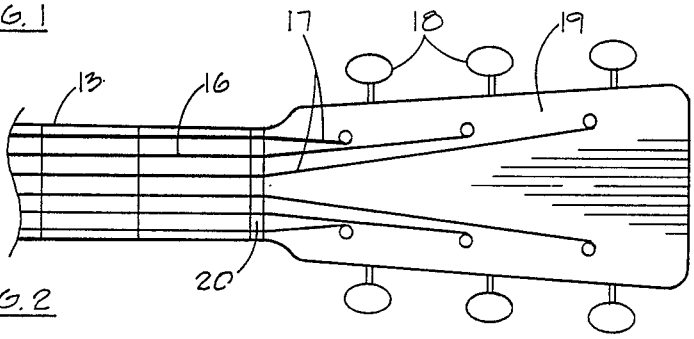
FIG. 2 is a plan view of another fragment of the guitar of FIG. 1, including the peg head thereof, drawn to the same scale.
Figure 3:
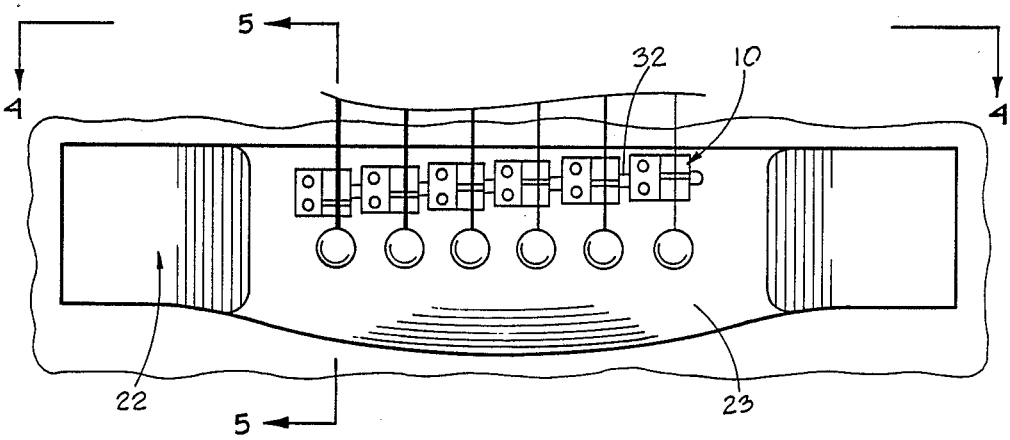
FIG. 3 is a plan view of a fragment of the guitar of FIG. 1 showing the bridge thereof with the saddle insert assemblies, drawn to substantially full scale.
Figure 4:
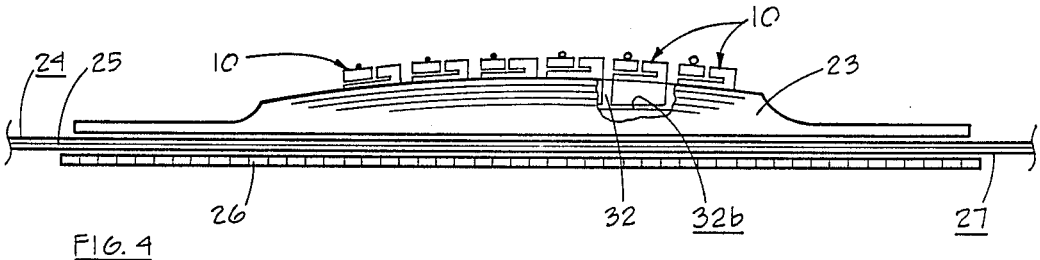
FIG. 4 is an elevation view of the fragment of FIG. 3, taken along line 4—4 thereof, showing the bridge partially cut away to partially show the saddle inserts, drawn to the same scale.
Figure 5:
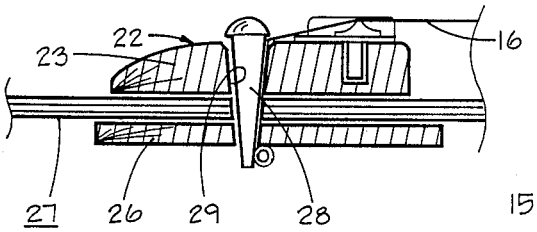
FIG. 5 is a vertical sectional view taken along line 5—5 of FIG. 3, drawn to an enlarged scale.

A set of six saddle insert assemblies 10 is illustrated in the drawings, installed upon a bridge of an acoustic guitar 11, for example. Guitar 11 comprises a resonating chamber or sound box 12 secured to an elongate neck 13. (FIGS. 1 & 2) Neck 13 carries a fret board 14 with individual frets 15. Each string 16 of the set of six is secured at one end 17 to one of the pegs 18 on a peg head 19 on the end of neck 13 distal from sound box 12. The strings are held spaced apart by a notched bar 20 called a "guitar nut", mounted transversely to neck 13. The other ends 21 of the set of strings 16 are secured to a bridge 22, the body 23 of which is secured to the upper surface 24 of the top plate 25 of sound box 12, usually by gluing. A stiffener plate 26 may be provided, similarly secured to the undersurface 27 of plate 25. String ends 21 are anchored by bridge pins 28, installed within bores 29 through the bridge body 23, top plate 25 and stiffener 26. (FIGS. 3–9) The saddle insert assembly 10 has an upwardly located saddle piece 30, which supports a string 16 upon an upper elongate ridge 31.

Figure 6:
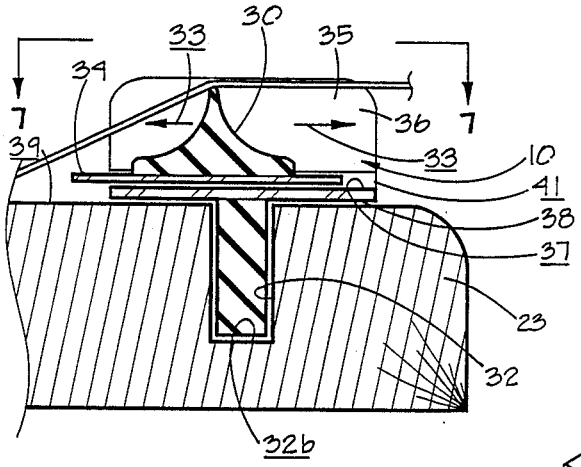
FIG. 6 is a fragment of the view of FIG. 5, drawn to a further enlarged scale.
Figure 9:
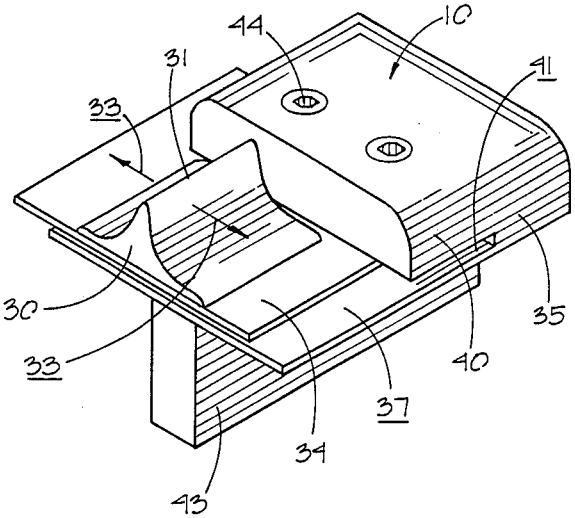
FIG. 9 is a perspective view of a saddle insert, including the saddle tray with attached saddle piece and the mounting block, drawn to the scale of FIG. 8.
Figure 7:
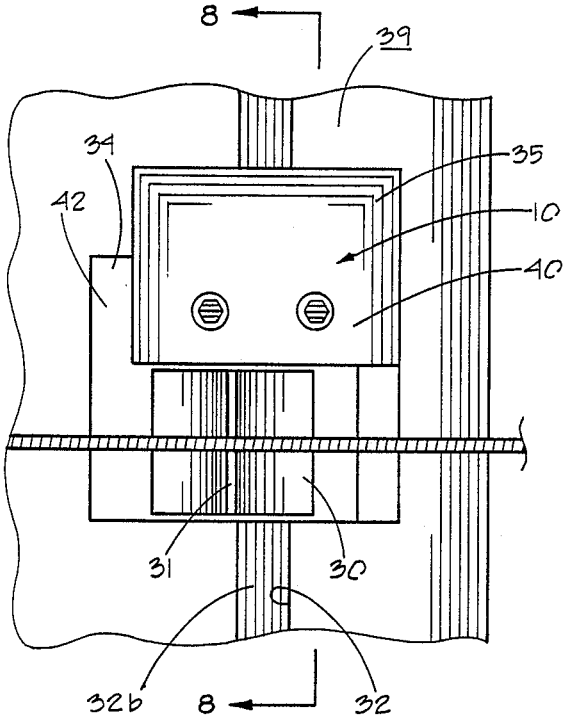
FIG. 7 is a top plan view of the fragment of FIG. 6, taken along line 7—7 thereof, drawn to the same scale.

Ridge 31, with the above-mentioned guitar nut 20, defines the total vibrating length of each string 16. The vibrating length, along with the string tension, unit mass and resilience characteristics of the string material, determines the basic pitch and tone of the string. Relatively small variations in string length are quite important for precise intonation (pitch adjustment). Accordingly, the heavier, lower pitch, strings are typically slightly longer than those of smaller diameter and higher pitch, to achieve correct scale pitch. The saddles of most instruments are positioned accordingly. Note the slightly angled direction of saddle slot 32. (FIG. 3) The saddle inserts 10 provide for individual adjustment of the position of each saddle piece 30 back and forth along each string 16, for precise intonation, as indicated by arrows 33. (FIGS. 6, 7 & 9)

Each insert 10 comprises the saddle piece 30, secured to a tray plate 34, and a mounting block 35. Upper portion 36 of block 35 provides an upper flat horizontal surface 37 upon which saddle tray 34 rests, and a lower such surface 38, upon which block 35 is supported upon the top surface 39 of bridge body 23. An overhanging portion 40 forms a slot 41 into which tray end portion 42 loosely fits. An elongate downstanding projection 43 is sized to fit closely within saddle slot 32, extending to near the bottom **32*b* thereof. Block 35 may be positioned transversely in slot 32 so that each string 16 rests centrally upon saddle ridge 31**, or at such other location the musician may prefer.

Figure 8:
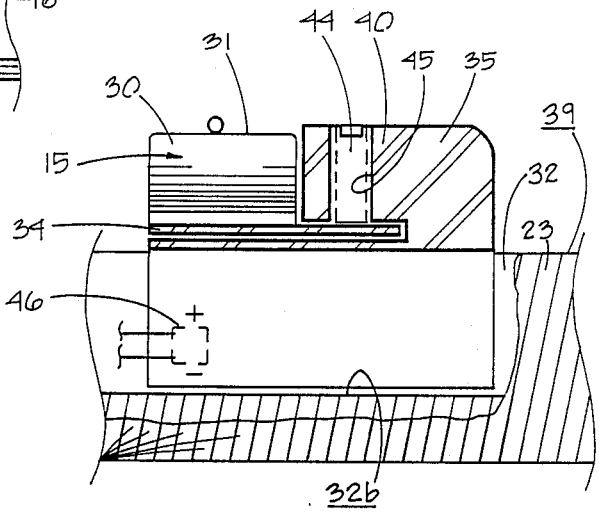
FIG. 8 is a vertical sectional view taken along line 8—8 of FIG. 5, drawn to the same scale.

For intonation, the musician slides each tray 34 along its slot 41 to locate attached saddle ridge 31 along each string 16 to a selected position for precise pitch and tone. A pair of set screws 44 in threaded bores 45 through overhang 40 are then tightened to retain each tray 34 and attached saddle piece 30 firmly in the selected position. Since bridge slot 32 is typically angled from the transverse of strings 16, ridge 31 of each saddle piece 30 is similarly angled. Because the angle is slight, this has had no significant affect upon intonation. However, projection 43 may, for example, be constructed angled to upper portion 36, to maintain the ridges 31 precisely perpendicular to strings 16. Saddle piece 30 is, preferably, originally constructed to place the saddle ridge 31 somewhat higher than desired above the instrument. The height of each saddle is then adjusted by the musician for the fretting height of his individual choice, by removing an appropriate amount of material from the top of ridge 31. Easily worked material is utilized for saddle piece 30 to facilitate this material removal. Pyrolitic graphite, cured carbon reinforced resins, wood, and the traditional bone and ivory are all easily worked by planing, sanding, or grinding and may also be preferred for their tonal characterisitcs. However, the softer metal alloys, such as of copper, aluminum and tin, are also satisfactory. The thin saddle tray 34 must normally be of harder alloy, for strength and dimensional stability. As indicated in FIG. 8, a peizo-electric sound pickup device 46 may be incorporated into each block 35, for use with amplification and speaker systems.

The inventin may be embodied in other specific forms without departing form the spirit or essential characteristics thereof. The present embodiments are therfore to be considered as illustrative and not restrictive, the scope of the invention being indicated by the appended claims rather than by the foregoing descrpiton, and all changes that come within the meaning and range of equivalency of the claims are therefore intended to be embraced therein.

What is claimed and desired to be secured by United States Letters Patent is:

1. An ajustable saddle bridge for a stringed musical insturment, comprising:

a main body having an elongate, upwardly opening, slot positioned transversely to and below the string, said slot having a pair of parallel opposed vertical side surfaces;

an individual saddle insert assembly at each string, each having;

a single-string saddle piece supporting the string at the bridge;

a mounting block carrying the saddle piece in unlimited selective position over an increment along the length of the string, said block having a downward facing surface configured to rest upon the uppermost surface of the main body; and means carried by the mounting block to engage the sides of the slot to secure the insert assembly to the main body.

2. For a stringed musical instrument having a bridge with a main body having a substantially flat upwardly facing surface and an elongate upwardly opening slot having a pair of facing vertical sides and positioned transversely to and below the strings, the improvement of an individual saddle insert assembly at each string, said insert asembly comprising:

a single-string saddle piece carried upon a thin, flat tray member;

a saddle mounting block having an upper portion with a substantially flat downwardly facing surface resting upon the upwardly facing surface of the main bridge body, an upwardly faing flat surface upon which the tray member may be selectively positioned, a part of the upper portion overhanging a portion of the tray-carrying surface and forming therewith a slot accepting a portion of the tray member therewithin, and a projection extending downwardly form the upper portion of the mounting block to snugly engage the sides of the slot; and set screw means carried by the overhanging part, so that the saddle piece may be selectively positioned for individual string intonation by positioning the tray upon the block and retaining it in selected position by the set screw means.

3. The improvement of claim 2, wherein:

the saddle piece has a thin, uppermost ridge upon which the string is supported, and which is dimensioned for removal of material therefrom to adjust the height of the string above instrument.

4. The improvement of claim 2 wherein:

the mounting block, saddle piece and tray are individually constructed of material selected from among bone, ivory, metals, alloys of metals, plastic materials, reinforced plastic materials, and graphitic materials.

5. The improvement of claim 2, the bridge slot being angled from perpendicular to the strings, wherein:

the saddle piece has a thin string-supporting ridge uppermost thereon; and the downward projection is angled with respect to the upper portion of the mounting block so that the ridge of the saddle piece is perpendicular to the string.

* * * * *